US008910325B2

(12) United States Patent
Faucher et al.

(10) Patent No.: US 8,910,325 B2
(45) Date of Patent: Dec. 16, 2014

(54) LIFT APPARATUS AND SYSTEM

(75) Inventors: Martin Faucher, Magog (CA); Marie-Lou Joncas, Sherbrooke (CA); Dennis-Alexandre Brulotte, Magog (CA)

(73) Assignee: ArjoHuntleigh Magog Inc., Magog, Quebec (CA)

( * ) Notice: Subject to any disclaimer, the term of this patent is extended or adjusted under 35 U.S.C. 154(b) by 309 days.

(21) Appl. No.: 13/577,805

(22) PCT Filed: Jan. 6, 2011

(86) PCT No.: PCT/CA2011/000003

§ 371 (c)(1),
(2), (4) Date: Oct. 17, 2012

(87) PCT Pub. No.: WO2011/097698

PCT Pub. Date: Aug. 18, 2011

(65) Prior Publication Data

US 2013/0038263 A1 Feb. 14, 2013

(30) Foreign Application Priority Data

Feb. 12, 2010 (CA) ..... 2692894

(51) Int. Cl.

| | |
|---|---|
| ***A61G 7/02*** | (2006.01) |
| ***B66D 3/20*** | (2006.01) |
| ***A61G 7/10*** | (2006.01) |
| ***B66D 1/54*** | (2006.01) |
| ***B66C 15/00*** | (2006.01) |
| ***B66C 13/16*** | (2006.01) |

(52) U.S. Cl.

CPC ..... *A61G 7/1042* (2013.01); *B66D 3/20* (2013.01); *A61G 7/1065* (2013.01); *A61G 2203/44* (2013.01); *B66D 1/54* (2013.01); *A61G 7/1051* (2013.01); *B66C 15/00* (2013.01); *B66C 13/16* (2013.01)

USPC ..... 5/84.1; 5/600; 5/611; 5/89.1; 5/109; 414/564; 414/749.1; 414/254; 414/43; 414/88; 212/283; 212/278; 212/284

(58) Field of Classification Search

USPC ..... 5/611, 81.1, 84.1, 89.1, 109, 600; 414/564, 749.1; 212/283, 278, 284; 254/88, 43; 318/434

See application file for complete search history.

(56) References Cited

U.S. PATENT DOCUMENTS

| | | | | |
|---|---|---|---|---|
| 3,877,421 | A | 4/1975 | Brown | |
| 6,289,534 | B1 * | 9/2001 | Hakamiun et al. | 5/89.1 |

(Continued)

FOREIGN PATENT DOCUMENTS

| | | | |
|---|---|---|---|
| CN | 101304717 | A | 11/2008 |
| DE | 19950689 | C2 | 12/2003 |
| EP | 0399836 | A2 | 11/1990 |

OTHER PUBLICATIONS

Office Action issued Jan. 24, 2014 in CN Application No. 201180009065.7.

(Continued)

*Primary Examiner* — Rita Leykin

(74) *Attorney, Agent, or Firm* — Panitch Schwarze Belisario & Nadel LLP

(57) ABSTRACT

A lifting apparatus for a lift system is disclosed. The apparatus includes a) a motor adapted for providing a lifting force, b) at least one connector operatively connected to the motor, the connector adapted for connecting a load-bearing component to the motor, c) an information receiver for receiving a load limit information about the load-bearing component, d) a motor controller electrically coupled to the motor and the information receiver, wherein the motor controller is adapted to limit the lifting force of the motor based on the load limit information received by the information receiver.

18 Claims, 5 Drawing Sheets

(56) References Cited

U.S. PATENT DOCUMENTS

| | | | | |
|---|---|---|---|---|
| 6,566,833 | B2 * | 5/2003 | Bartlett | 318/564 |
| 6,966,544 | B2 * | 11/2005 | McCormick et al. | 254/342 |
| 7,240,621 | B2 * | 7/2007 | Chepurny et al. | 104/173.1 |
| 7,472,440 | B2 * | 1/2009 | Bartlett et al. | 5/607 |
| 7,634,825 | B2 | 12/2009 | Chepurny et al. | |
| 2008/0128668 | A1 * | 6/2008 | Fofonoff et al. | 254/334 |
| 2009/0218975 | A1 | 9/2009 | Bastholm | |
| 2010/0224841 | A1 | 9/2010 | Liljedahl | |

OTHER PUBLICATIONS

Int'l Search Report and Written Opinion issued on Apr. 21, 2011in Int'l Application No. PCT/CA2011/000003.

* cited by examiner

LIFT APPARATUS AND SYSTEM

CROSS-REFERENCE TO RELATED APPLICATION

This application is a Section 371 of International Application No. PCT/CA2011/000003, filed Jan. 6, 2011, which was published in the English language on Aug. 18, 2011, under International Publication No. WO 2011/097698 A1, and the disclosure of which is incorporated herein by reference.

FIELD

Embodiments described herein relate to an apparatus and systems for a ceiling lift system. More particularly, embodiments described herein relate to apparatuses and systems for controlling the operation of the ceiling lift system based on load limit information.

INTRODUCTION

Lift systems are common to hospitals, care facilities, and even within homes. The systems often include a track, a motor, a spreader, and a sling for hoisting a user into the air and translating the user along the mounted track. Variants of lift systems include ceiling lift systems and floor lift systems. These types of systems for carrying the elderly and the invalid are popular as they provide improved mobility and independence for their users while reducing the risk of injury to assistants and caregivers.

SUMMARY

Embodiments described herein relate to apparatuses and systems for a ceiling lift system limiting the lifting force of the motor of the ceiling lift system based on load limit information.

In one broad aspect there is provided a lifting apparatus for a lift system. The apparatus includes a) a motor adapted for providing a lifting force, b) at least one connector operatively connected to the motor, the connector adapted for connecting a load-bearing component to the motor, c) an information receiver for receiving a load limit information about the load-bearing component, d) a motor controller electrically coupled to the motor and the information receiver, wherein the motor controller is adapted to limit the lifting force of the motor based on the load limit information received by the information receiver.

In another feature of that aspect, the motor controller is adapted to limit the lifting force of the motor to a load limit contained in the load limit information.

In another feature of that aspect, the lifting apparatus includes a plurality of connectors and each of the connectors is adapted for connecting one of a plurality of load-bearing components. Furthermore, the motor controller can be adapted to compare the load limit of each load-bearing component and determine a lowest load limit and use this information to limit the lifting force of the motor to the lowest load limit.

In another feature of that aspect, the lifting apparatus includes a display for displaying a limit of the lifting force of the motor.

In another feature of that aspect, the information receiver is adapted to receive a communication from a transmitter, wherein the transmitter is associated with the load-bearing component and wherein the communication comprises the load information. The receiver and the transmitter may be electrically coupled. Alternatively, the receiver and the transmitter may be optically coupled. The information receiver may also comprise a radio frequency receiver. The transmitter may reside on the associated load-bearing component. The load-bearing components may be selected from the group consisting of a track, a spreader bar, and a sling. In some embodiments, the load-bearing components could also comprise additional components such as installation hardware including one or more brackets used to mount the ceiling lift system. In some embodiments, the load bearing components can also comprise any structural feature of the lifting system including but not limited individual nuts and/or bolts used in the system. Furthermore, the load information transmitted by the transmitter may include a safe working load of the associated load-bearing component.

In another feature of that aspect, the lifting apparatus includes at least one key, wherein the information receiver is operatively coupled to a key interface and the key interface is adapted for receiving each of the at least one key. Each of the at least one key may be associated with a predetermined lifting force. The key interface may include a plurality of pin combinations, where each pin combination may be associated with a predetermined lifting force; and a selected key may engage a corresponding pin combination to limit the lifting force of the motor to the predetermined lifting force associated with the selected key and the pin combination. Furthermore, the key may include the display for displaying the limit of the lifting force of the motor. Additionally, the key interface may reside on the apparatus. Alternatively, the key interface may also reside on a load-bearing component, where the load-bearing component is adapted to be coupled to the apparatus.

In another broad aspect, there is provided a lift system. The lifting system includes a) a motor adapted for providing a lifting force, b) a plurality of connectors operatively connected to the motor, each of the connectors adapted for connecting one of a plurality of load-bearing components to the motor, c) an information receiver for receiving a load limit information associated with each of the plurality of load-bearing component; and d) a motor controller electrically coupled to the motor and the information receiver, wherein the motor controller is adapted to compare the load limit information of each load-bearing component and determine a lowest load limit, wherein the motor controller is adapted to limit the lifting force of the motor to the lowest load limit.

In yet another broad aspect, there is provided another lift system. The lifting system includes a) a motor adapted for providing a lifting force, b) a plurality of connectors operatively connected to the motor, each of the connector adapted for connecting one of a plurality of load-bearing components to the motor, c) an information receiver for receiving a load limit information from a key interface; d) a key interface coupled to the information receiver, the key interface comprising a plurality of pin combinations, each pin combination associated with a predetermined lifting force; e) at least one key, each of the at least one key is associated adapted to engage a corresponding pin combination of the key interface; and f) a motor controller electrically coupled to the motor and the information receiver, wherein the motor controller is adapted to determine the engaged pin combination, wherein the motor controller is adapted to limit the lifting force of the motor to the predetermined lifting force associated with the engaged pin combination.

BRIEF DESCRIPTION OF THE DRAWINGS

For a better understanding of embodiments of the apparatuses and systems described herein, and to show more clearly how they may be carried into effect, reference will be made, by way of example, to the accompanying drawings in which.

Figure 1:
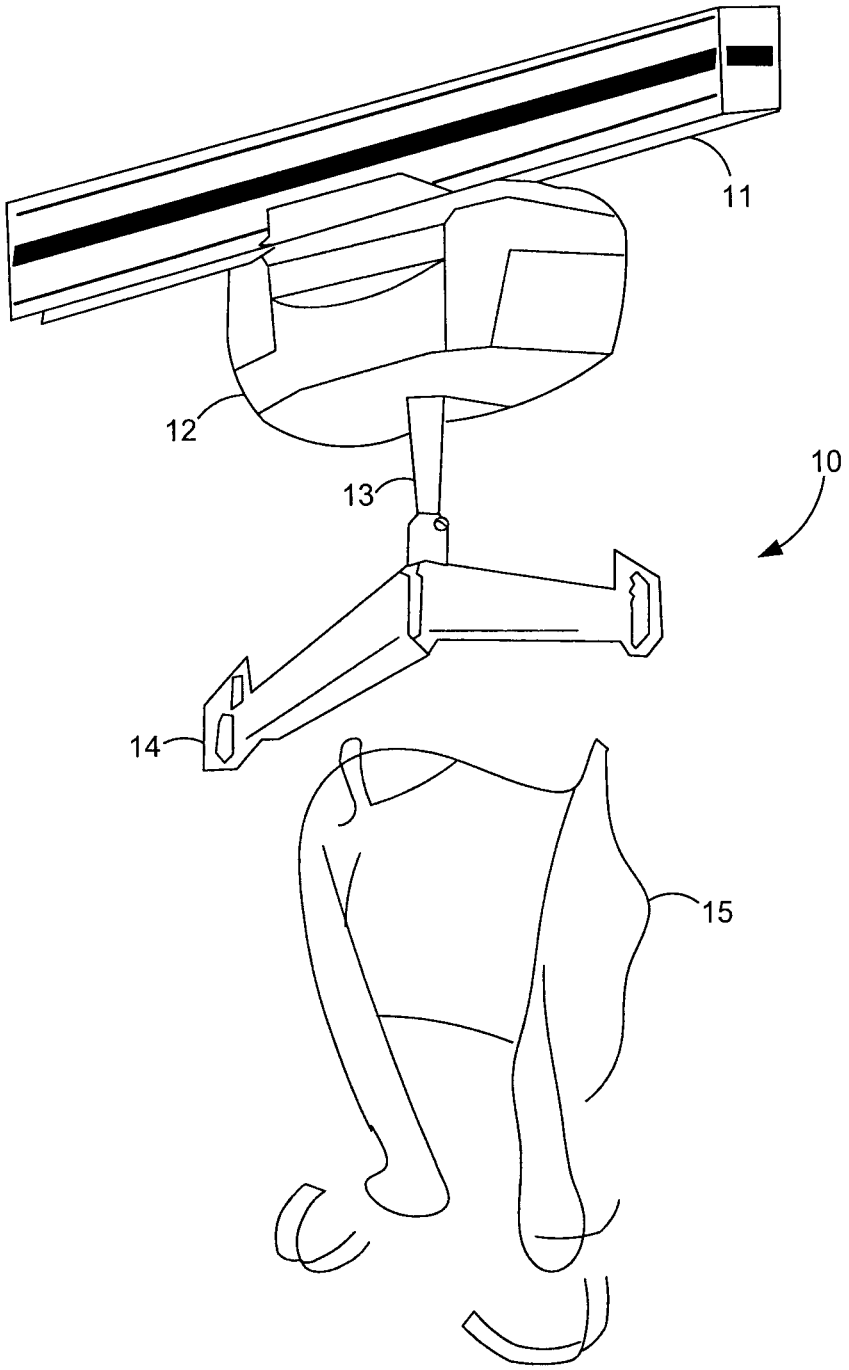
FIG. 1 is an isometric drawing of a lift system.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the example embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Lift systems are becoming popular choices for installations within both care facilities and individual homes. They allow the caregiver, or sometimes the user himself or herself, to gain mobility throughout the area where the lift system is installed. Floor lifts are common for hoisting a patient between two locations, such as between a bed and a chair. They provide assistance in situations where multiple people would normally need to assist a user and reduce the risk of injury to the caregiver. On the other hand, ceiling lift systems can be very versatile. Unlike floor lifts, they take up little floor space and the lifting apparatus itself may be stored at the end of the track 11, often in corners or unobtrusively along walls. Such versatility can allow them to get into smaller and congested areas that may be unreachable by other solutions. In many situations, ceiling lift systems are also more efficient than floor lifts.

The embodiments disclosed herein may be incorporated as part of any suitable lift system, including but not limited to ceiling lift systems or floor lift systems. One example of a floor lift system to which the embodiments disclosed herein can be applied is Maxi Move™ manufactured by BHM Medical Inc. An example of a ceiling lift system to which the embodiments disclosed herein can be applied is Maxi Sky 600™ manufactured by BHM Medical Inc.

Reference is now made to FIG. 1, which shows an example ceiling lift system 10. The ceiling lift system 10 includes a lifting apparatus 12 and load-bearing components 11, 14, 15 connected to the lifting apparatus 12. The load-bearing components 11, 14, 15 include individual components, such as a track 11, a spreader 14, and a sling 15. Those skilled in the art will understand that other load-bearing components, such as hardware components for installing the ceiling lift system may also be provided. These components may include brackets used to mount the ceiling lift apparatus. In some embodiments, load-bearing components may include any suitable structural elements of the ceiling lift system 10 or a floor lift system including, but not limited to individual fasteners such as nuts and/or bolts.

Although FIG. 1 illustrates an example of an embodiment of the present invention applicable to a ceiling lift system, those skilled in the art will understand that embodiments of the present invention may be adapted to floor lift systems as well. Embodiments of floor lift systems (not shown) generally do not include a track, such as track 11 discussed above, but can generally include each of the other load-bearing components illustrated in and discussed in relation to FIG. 1. Those skilled in the art will also understand that embodiments of floor lift systems may also include, for example, a base, which can include legs, mounted on wheels, a mast mounted to the base, and a boom mounted to the mast. In such embodiments, a spreader bar and sling can be coupled to the end of the boom. Embodiments of both ceiling lift systems and floor lift systems can include other load bearing components as well.

The lifting apparatus 12 provides a lifting force in a substantially vertical direction. Connector 13 is used to connect some of the load-bearing components to the lifting apparatus 12. Additionally, the lifting apparatus 12 can move horizontally. The system can include a track 11 mounted to a ceiling to accommodate movement in the horizontal direction. The lifting apparatus 12 can be operatively coupled to the track 11 to allow movement along the track path. In some embodiments, the track path may include a vertical component such as for example when a ceiling is sloped in at least some areas.

To transfer a patient using a ceiling lift system, the user is placed in a load-bearing component, such as a sling 15, which is connected to the lifting apparatus 12. A spreader 14 can form an additional load-bearing component and a flexible member 13 can act as a connector to connect the spreader 14 and the sling 15 to the lifting apparatus 12. The lifting apparatus 12 then raises the user to the appropriate level. Once the lifting apparatus 12 has reached the appropriate height, a locking mechanism (not shown) may be engaged to hold the user in the lifted position. The user is now positioned to travel along the track 11. Some embodiments of ceiling lift systems 10 allow a caregiver to manually push or pull the lifting apparatus 12 along the track 11. Other embodiments of ceiling lift systems 10 include a second motor (not shown) as part of the lifting apparatus 12 to move the user in the horizontal direction. The lifting apparatus 12 can be fixed to a particular laid track 11. In other systems, the lifting apparatus 12 is portable and can be removed from one track 11 and placed onto another track.

Each lifting apparatus 12 includes a motor adapted for providing a lifting force to raise a load-bearing component and its associated load. As mentioned, a lifting apparatus 12 may also include a second motor for providing a horizontal force to power the lifting apparatus 12 along the track 11. Each load-bearing component of ceiling lifting system 10 has a load limit. This rating is an indication of the load that the load bearing component can bear according to its design parameters. In some embodiments, the load limit may be below the maximum load that the load-bearing component can actually bear. In some other embodiments, the load limit may be equal to the maximum load the load bearing component can actually bear. In some embodiments, the load limit may be referred to as a Safe Working Load (SWL).

Known lift systems generally limit the lifting force to the load limit of the motor that provides the lifting force. This load limit can be unique to each model of motor used and is dependent on the design, construction and current limitations of the motor. However, the load limit of a motor in known lift systems is generally independent of load limits of the load-bearing components to which the motor is mechanically coupled. In known lift systems there is no communication between the load-bearing components of the lift system and the motor. While known lifting apparatuses may limit the lifting force to the load limit of the motor, they do not incorporate any load limit information from the individual load-bearing components 11, 14, 15. In some embodiments, ceiling lift system 10 can account for the load limit information from various load-bearing components attached to a lifting apparatus and can ensure that the ceiling lift system 10 responds appropriately to loads that are greater than a lifting force limit based on the load limit information.

Some embodiments described herein relate to a ceiling lift apparatus and systems adapted for limiting the lifting force of a motor based on the load limit information received by the information receiver. In particular, some embodiments disclosed herein relate to ways of providing load limit information from one or more load-bearing components to the information receiver and preventing the lifting apparatus 12 from operating outside the received load limit information. Accordingly, some embodiments ensure that all the load-bearing components of the ceiling lift system do not bear a load that is greater that their respective load limits.

Figure 2A:
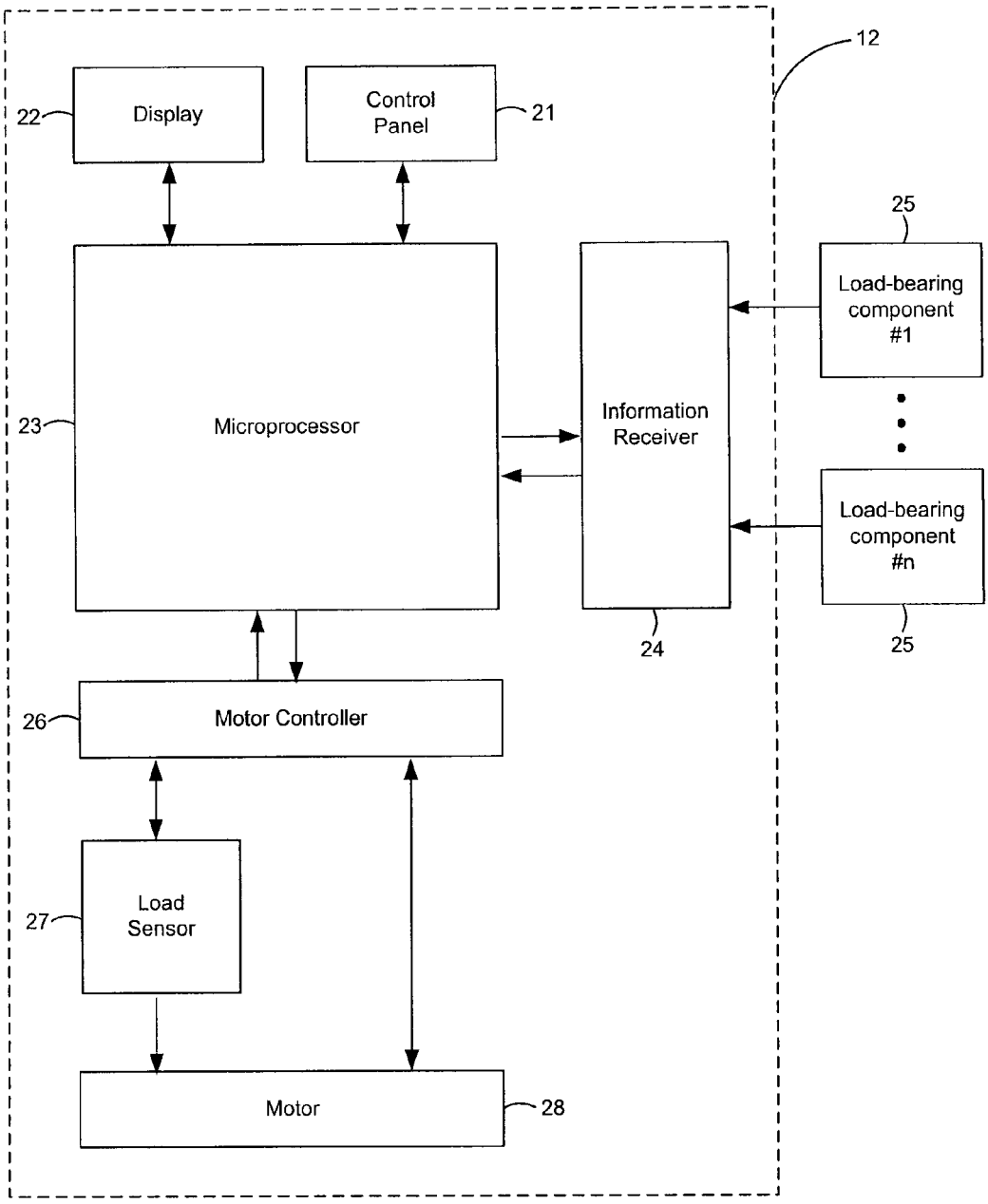
FIG. 2A is a block diagram of a lifting apparatus in accordance with a first embodiment.

Reference is now made to FIG. 2A, which shows a block diagram of a lifting apparatus 12, in accordance with an embodiment. Lifting apparatus 12 may be utilized in any suitable lift system including but not limited to a ceiling lift system and a floor lift system. The lifting apparatus 12 includes a microprocessor 23 for coordinating the functions of the lifting apparatus 12, an information receiver 24 to receive load limit information about the one or more load-bearing components 25, and a motor controller 26 for controlling the functions of the motor 28 and specifically adapted to limit the lifting force of the motor based on the load limit information received by the information receiver 24. In some embodiments, the microprocessor 23, information receiver 24, and motor controller 26 are implemented on a single chip. In other embodiments, the information receiver 24 and motor controller 26 are incorporated into the functions of the microprocessor 23 and implemented in software or a combination of software and hardware. Those skilled in the art will understand that the microprocessor 23, information receiver 24, and motor controller 26 may be implemented in any other suitable configuration.

Some embodiments of the lifting apparatus 12 include a display 22 and a control panel 21. The display 22 can be used to indicate the different modes and settings of the lifting apparatus 12. It can also be used to indicate different parameters, including but not limited to the load limits of one or more of the load bearing components or the overall load limit (e.g. the lowest load limit) of the lifting system. In some embodiments, display 22 can include any appropriate electronic display device including but not limited to liquid crystal display (LCD). In some embodiments, display 22 can include any other appropriate manner of displaying information, such as for example a sticker on any appropriate component of the system. The control panel 21 is used to operate the lifting apparatus 12. In some embodiments, the control panel 21 may also include a wired or wireless remote control (not shown) to receive instructions from either the user or a caregiver.

The load sensor 27 is connected to the motor 28 and to the motor controller 26. The load sensor 27 can also be directly coupled to the microprocessor 23. Alternatively, the load sensor 27 can be coupled to a load-bearing component or a connector coupling a load-bearing component to the lifting apparatus 12, such as the flexible arm 13.

The motor 28 used by the lifting apparatus 12 can be any appropriate motor including an electric motor known to persons skilled in the art. The motor 28 can be either a DC-controlled motor or an AC-controlled motor. Provided that a DC motor is used, the supply voltage will control the lifting speed of the motor. Provided that an AC motor or a stepping motor is used, the lifting speed of the motor will be controlled by the supply frequency.

In a preferred embodiment, the information receiver 24 receives load limit information from one or more load-bearing components 25. Each load-bearing component 25 is operatively coupled to send load information to the information receiver 24. The information receiver 24 and the microprocessor 23 then limit the lifting force of the motor based on this load limit information.

The load limit information sent to the information receiver 24 may take a number of forms. In some embodiments, the load limit information may include the safe working load specific for the particular load-bearing component 25. In other embodiments, the load limit information may only indicate to the information receiver 24 a predetermined lifting force.

In some embodiments, the microprocessor 23 and the information receiver 24 compare the load limit information received from each of the load-bearing components 25 and the motor 28 and limit the lifting force of the motor to the lowest load limit. The microprocessor 23 may also limit the lifting force of the motor using other methods.

In some embodiments, a user may input the load limit information directly into the lifting apparatus 12. This may be done through the control panel. Some embodiments of the lifting apparatus 12 may allow the user to input load limit information for each of the load-bearing components 25. Alternatively, the user may determine the lowest load limit and input a single safe working load into the lifting apparatus 12. Once the lowest load limit has been set or a limit to the lifting force of the motor otherwise determined, the lifting apparatus 12 will not allow the motor 28 to provide a lifting force greater than this limit.

In some embodiments, the lifting apparatus 12 includes at least one connector (not shown) operatively coupled to the motor 28. This connector can be the flexible arm 13 that is used to connect the motor 28 to a spreader 14 and to a sling 15. Another connector, such as wheels or a pulley system, can be used to couple the motor 28 to the track 11. Any other suitable connector for connecting the motor 28 to one or more load-bearing components 25, may also be used.

The information receiver 24 is used to transfer to the microprocessor 23 load limit information from each of the load-bearing components 25. This load limit information can indicate the load limit for each load-bearing component 25. For example, each of the load-bearing components 25, such as the track 11, the spreader 14 bar, and the sling 15, can have a different load limit. The load limit of the load-bearing components 25 can be different from the load limit of the motor 28. In some embodiments, in order to ensure that the lifting apparatus 12 takes into consideration the load limit information of the motor 28 and all of the load-bearing components 25, the information receiver 24 first gathers all of the load limit information from each of the load-bearing components 25. Once all the load limit information has been gathered, the microprocessor 23 and the motor controller 26 limit the lifting force of the motor based on the load limit information received by the information receiver 24. This limit on the lifting force of the motor may be indicated to the user or caregiver on the display 22. As mentioned above, display 22 can include any appropriate electronic display device or any other manner of displaying information such as for example a sticker attached to a component of the lifting apparatus 12 or implemented in any appropriate manner.

Referring again to FIG. 2A, the load limit information from a load-bearing component 25 is received by the information receiver 24. The information receiver 24 sends load limit information to the microprocessor 23. In some embodiments, the information receiver 24 sends the lowest load limit to the microprocessor 23. In other embodiments, the information receiver 24 relays all of the load limit information to the microprocessor 23. As mentioned above, the information receiver 24 can be a separate component of the lifting apparatus 12. In other embodiments, the information receiver 24 may be part of the microprocessor 23 and implemented in hardware or software in accordance with methods known to persons skilled in the art.

Communication between the information receiver 24 and the load-bearing components 25 can be implemented in any appropriate manner. In some embodiments, the load limit information is stored on the load-bearing component 25 and transferred to the information receiver 24 upon request. For example, the load-bearing component 25 can include a transmitter (not shown in FIG. 2A) that communicates with the information receiver 24 the load limit information for the particular load-bearing component 25. This communication may occur over an electrical connection that couples the load-bearing component 25 to the information receiver 24. In another aspect of this feature, the connection between the load-bearing component 25 and the information receiver 24 may be an optical signal over a fiber-optic connection.

In some embodiments, separate connections for each load-bearing component 25 are used to indicate the load limit information to the information receiver 24. In other embodiments, the communication occurs over a shared path or bus and use one of a number of known communication arrangements such as daisy chaining and multiplexing or one of a number of standards such as the Ethernet standard and the Universal Serial Bus (USB) protocol.

Communication between the load-bearing components 25 and the information receiver 24 can also occur wirelessly. The load-bearing component 25 may include a wireless transmitter (not shown in FIG. 2A) or a transceiver (not shown in FIG. 2A) and the information receiver 24 may include a wireless receiver (not shown in FIG. 2A) or a transceiver (not shown in FIG. 2A) to communicate the load limit information from the load-bearing components 25. The information may be passed through two-way communication standards, such as the 802.11 standards, the Bluetooth™ protocol, or other known or custom wireless methods.

The information may also be passed through one-way communication methods such as radio frequency identification (RFID) tags. In such an embodiment, the RFID tag (not shown), upon interrogation by the information receiver 24, responds to the interrogation with load limit information. The RFID tag associated with each load-bearing component 25 may be built into the load-bearing component 25. Alternatively, the RFID tag may be placed onto the load-bearing component 25 using a sticker or other attachment means. The SWL of the load-bearing component 25 may be displayed on the sticker.

Figure 2B:
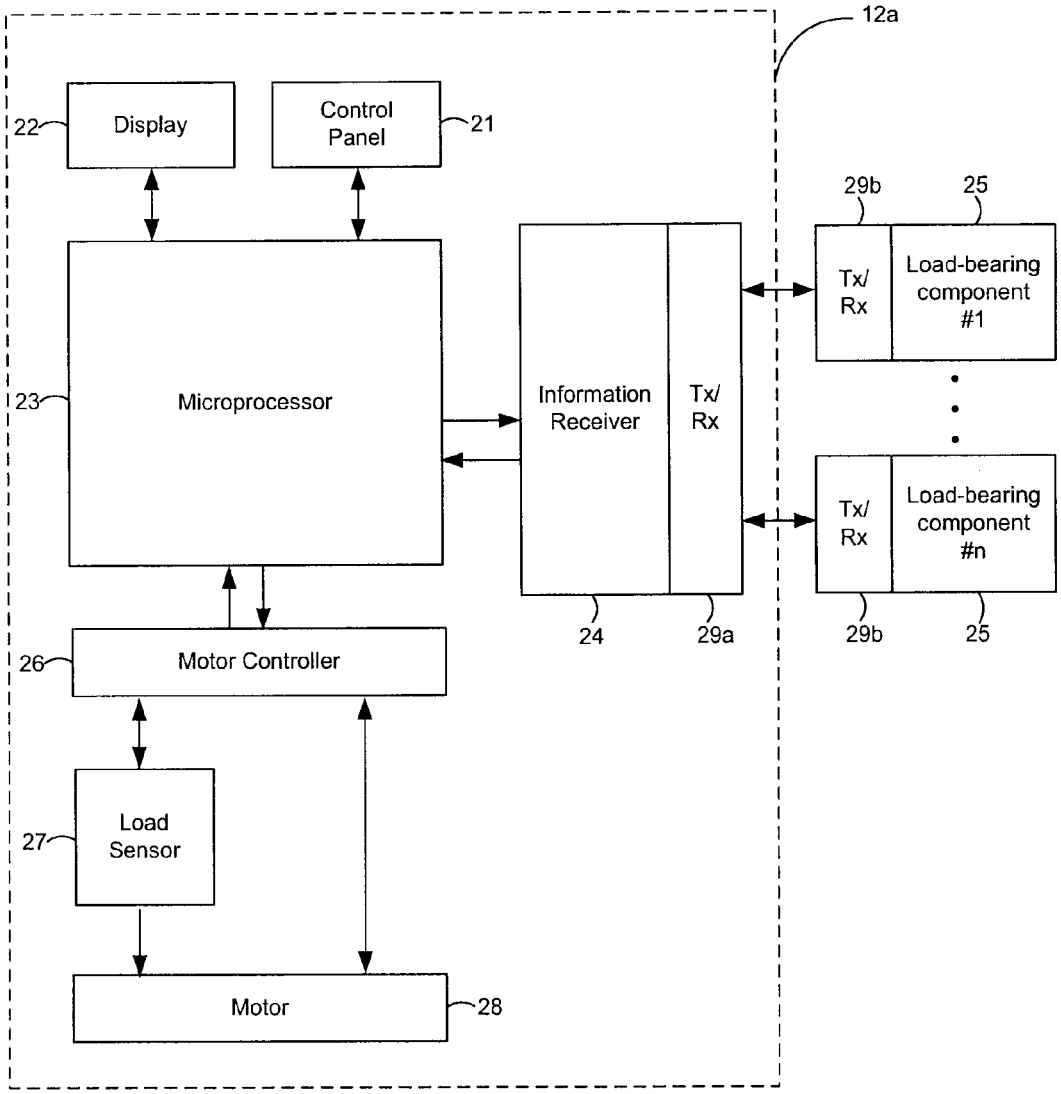
FIG. 2B is a block diagram of a lifting apparatus in accordance with a second embodiment.

Reference is now made to FIG. 2B, which shows a block diagram of a lifting apparatus 12*a*, in accordance with another embodiment. FIG. 2B is similar to FIG. 2A, except that communication between the information receiver 24 and the load-bearing components 25 include radio frequency transmitter/receiver 29*a* and radio frequency transmitter receiver 29*b*.

The information receiver 24 in the lifting apparatus 12*a* includes a transmitter/receiver 29*a* and each load-bearing component 25 includes a transmitter/receiver 29*b*. As described above, the transmitters/receivers 29*a*, 29*b* allow the load-bearing components 25 to communicate load limit information to the information receiver 24 using one of a number of different communication methods. In some embodiments, the transmitters/receivers 29*a*, 29*b* can include only a transmitter or only a receiver with information flowing in a single direction. In other embodiments, the transmitters/receivers 29*a*, 29*b* may communicate in both directions and information may flow both to and from the load-bearing components 25. In some embodiments transceivers may be used for this purpose.

Those skilled in the art will appreciate that the communication methods described above were discussed by way of example only and are not intended to be limiting as to the form of communication between the load-bearing components 25 and the information receiver 24. Any appropriate form of communication using any combination of transmitter/receiver 29*a* and transmitter/receiver 29*b* may be used.

Figure 3A:
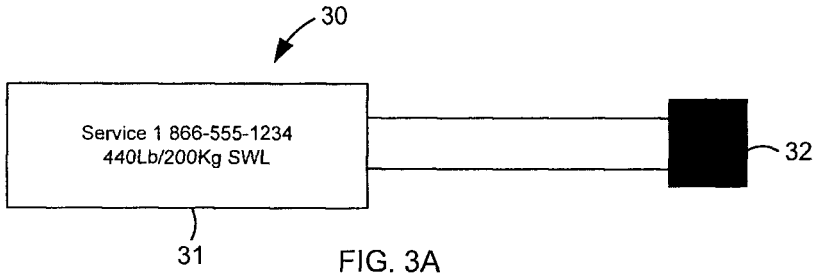
FIG. 3A is a schematic of a key in accordance with some embodiments of the present invention.
Figure 3B:
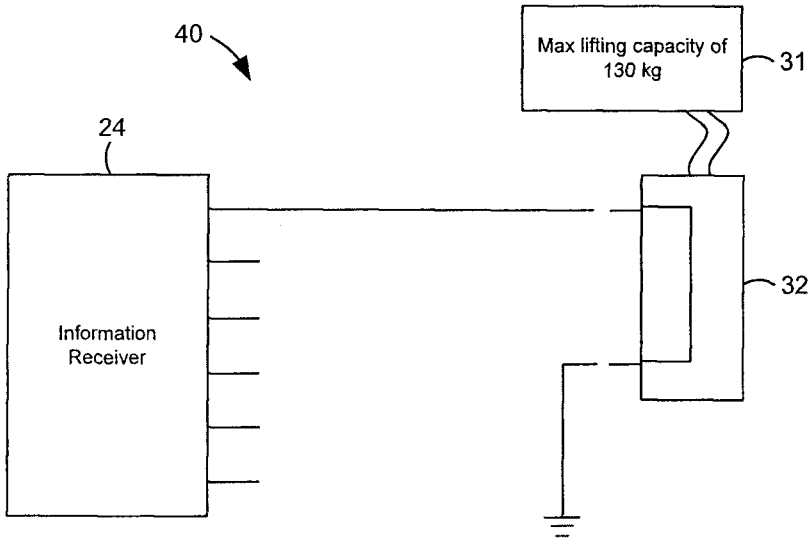
FIG. 3B is a schematic of a key interface receiving a first key in accordance with some embodiments of the present invention.
Figure 3C:
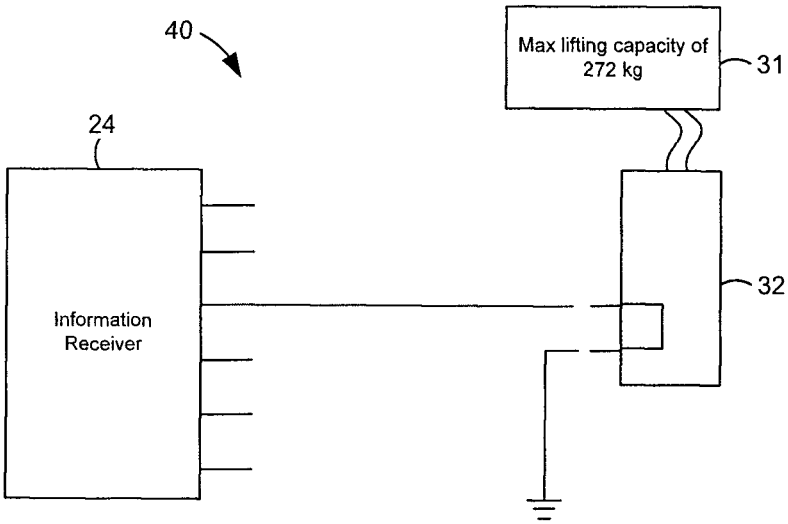
FIG. 3C is a schematic of a key interface receiving a second key in accordance with some embodiments of the present invention.

Reference is now made to FIG. 3A to FIG. 3C, which illustrate a method for utilizing one or more custom keys 30 to indicate load limit information, according to some embodiments. A key 30 can be received by a key interface 40 coupled to the information receiver 24. The load limit information for a particular load-bearing component may thus be separated from the physical load-bearing component 25. Instead, the load limit information may reside on one or more separate keys 30 that can be coupled to the lifting apparatus 12. Each key 30 may communicate the load limit information to the information receiver 24 through the key interface 40.

The load-bearing component manufacturer may produce a key 30 specific to the load-bearing component 25. Alternatively, the lifting apparatus manufacturer may provide a number of keys 30 with the lifting apparatus 12 suitable for different load-bearing components 25.

Each key 30 can be associated with a particular load-bearing component 25 and can include a label 34 or any other appropriate display to display its safe working load. This label 34 can be visible to the user or the caregiver when inserted into the key interface 40 and can provide the user or caregiver the ability to quickly determine the lowest load limit associated with either the motor 28 or the load-bearing components 25. If there are multiple labels 34 associated with multiple keys 30, the user or caregiver may have to compare the labels 34 of each of the keys 30 to determine the lowest load limit for the lifting apparatus 12. In addition, the display 22 may also show the limit of the lifting force of the motor based on the load limit information. In some embodiments, the keys 30 comprise display 22.

In some embodiments, the key interface 40 may receive a single key 30. In such embodiments, the user or installer of the system determines prior to using the lifting apparatus 12 the limit of the lifting force of the motor. In many cases this will be the lowest load limit of the individual load-bearing components 25 and the motor 28. In other embodiments, multiple keys 30 are inserted into the key interface 40. Each key 30 may represent a different load-bearing component 25. The information receiver 24 can then compare the multiple keys 30 to determine the lowest load limit for the lifting apparatus 12.

The key interface 40 can reside directly on the lifting apparatus 12. In other cases, the key interface 40 may reside on one of the load-bearing components 25 that is coupled to the lifting apparatus 12 or in any other suitable location. The key interface 40 may then communicate with the information receiver 24 as described by one of the communication methods above.

Referring now to FIG. 3A, an example key 30 is disclosed. The key 30 includes a label 34 indicating a predetermined load limit and a key circuit 32. The key circuit 32 is received by the key interface 40 which when coupled to the key circuit 32 indicates load limit information to the information receiver 24.

In some embodiments, each key 30 is associated with and represents a load-bearing component 25 and incorporates the load limit of the associated load-bearing component 25 within the key 30. In other embodiments, each key 30 is associated with one of a number of predetermined lifting forces or range of lifting forces. The key 30 may then indicate to the information receiver 24, which predetermined lifting force or predetermined range of lifting forces is associated with the load-bearing component 25.

According to some embodiments, each key interface 40 includes a number of possible pin combinations, where each pin combination is associated with a predetermined lifting force or range of lifting forces. Accordingly, the selected key engages a corresponding pin combination via the key circuit 32 to limit the lifting force of the motor to the predetermined lifting force associated with the selected key 30 and pin combination.

Referring now to FIG. 3B and FIG. 3C, a key interface 40 is shown with two example keys 30. The key interface 42 contains a number of pins 44. Different combinations of pins 44 correspond with different predetermined lifting forces. When coupled, the key 30 via the key circuit 32 indicates to the key interface 42 the predetermined lifting force associated with the key 30. By engaging different combinations of pins 44, the key 30 is able to indicate a number of different predetermined lifting forces. In some embodiments, engaging a combination of pins 44 may comprise shorting one or more pins 44 to ground.

In other embodiments, the keys 30 include a memory unit (not shown) to store the load limit information from each of the load-bearing components 25. The memory unit may take a number of forms. In some embodiments, the key interface 42 includes a USB hub and each key 30 incorporates flash memory to store the load limit information associated with the load-bearing component. Other forms of volatile and non-volatile memory are also possible for storing the load limit information within the key 30.

Referring again to FIG. 2A, the load sensor 27 measures the lifting force of the motor. This information can be sent to the microprocessor 23. In some embodiments, the load measured by the load sensor 27 is indicated to the user or caregiver on the display 22. In some embodiments, the load sensor 27 measures the lifting force of the motor by measuring the amount of current drawn by the motor 28. As known by persons skilled in the art, the amount of current drawn by a motor 28 is proportional to the load placed on the motor 28. A motor 28 requiring a greater amount of torque in order to accommodate a larger load will draw more current. Accordingly, the load sensor 27 may measure the current being drawn by the motor 28 from the power supply (not shown) during a lifting motion to infer the lifting force of the motor.

A table can be provided for a given motor 28 correlating the amount of current drawn to the lifting force of the motor. The relation of current consumption during lifting to the amount of weight lifted may be determined by experimentation or may be obtained from the motor manufacturer. Referring to FIG. 2A, the load sensor 27 can be coupled to the power supply of the motor. The load sensor 27 may measure the amount of current drawn by the motor 28 from the power supply and transmit this information to the microprocessor 23 for table lookup. Accordingly, in some embodiments, a measurement of the current provided to the motor 28 is used by the motor controller 26 and the microprocessor 23 to determine the lifting force of the motor 28 for any given load. This measurement may take into account an inrush current experienced by the motor 28. In some embodiments, the steady state current may be measured by implementing a delay in the current measurement. In other embodiments, any other suitable method for accounting for the inrush current can be used.

In other embodiments, the load sensor 27 is implemented using any suitable force measuring transducer. The transducer is coupled to the lifting apparatus 12 to directly measure the vertical force on the lifting apparatus 12. Some examples of transducers known in the art include strain gauges, pressure sensors, or piezoelectric sensors. Such measuring transducers can measure the lifting force being applied to the lifting apparatus 12 whether or not the motor 28 is engaged. In such instances, it is possible to provide load information to the motor controller 26 and microprocessor 23 before attempting to lift the load and prior to supplying any current.

Once the lifting apparatus 12 has received load limit information from the load-bearing components 25 and has a method for measuring the lifting force of the motor, the microprocessor 23 and the motor controller 26 can limit the operation of the lifting apparatus 12 based on the load limit information. In some embodiments, the lifting force of the motor will be limited to a load limit contained in the load limit information from one of the load-bearing components 25. In many situations, the limit will be the lowest load limit; however, this is not necessary and need not always be the case.

To limit the lifting force of the motor, the motor controller 26 can implement a control system that periodically monitors the load sensor 27. When the load sensor 27 indicates to the motor controller 26 that the weight of the load has approached or exceeded the safe working load of the lifting apparatus 12, the motor controller 26 can disengage the motor 28 and safely bring the operation of the lifting apparatus 12 to a halt. Other actions may also be taken when the lifting force of the motor exceeds the set limit based on the load limit information. In some embodiments, the lifting apparatus 12 will provide an indication to the user or the caregiver that the lifting force of the motor has exceeded the set limit.

Figure 4A:
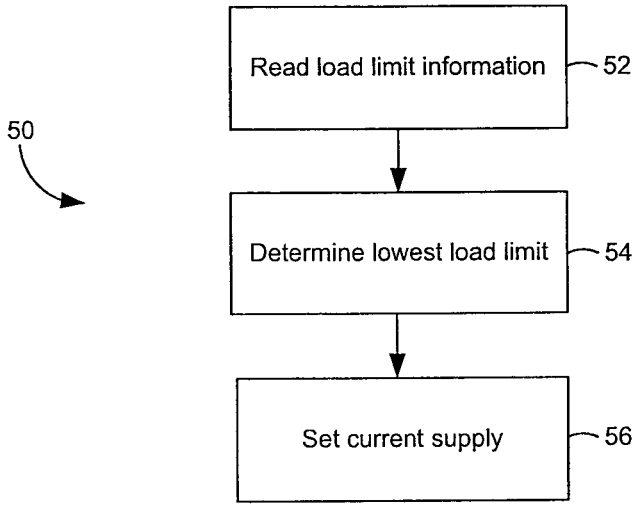
FIG. 4A is a flowchart of a method for determining if the limit of the lifting force of the motor has been exceeded in accordance with some embodiments of the present invention.

Reference is now made to FIG. 4A, where a flowchart shows a method 50 where measurements are taken and compared to the load limit information received from the information receiver 24. In step (52), the method measures the lifting force of the motor. The measurement is made using one of the different methods described above. Next, a comparison is made with the load limit information in step (54) to determine if the lifting force of the motor exceeds the limit set by the information receiver 24 based on the load limit information from each of the load-bearing components. If the limit is not exceeded, the operation of the lifting apparatus 12 continues in step (56). Otherwise, the limit on the lifting force of the motor has been exceeded and the microprocessor 23 generates instruction to this overload condition in step (58). Such instruction includes stopping the motor 28 and providing an indication that the limit has been exceeded.

In some embodiments, the load lifted by the lifting apparatus 12 is not determined. In some embodiments the current supplied to the motor 28 of the lifting apparatus 12 is limited to an appropriate level. In some such embodiments, the system does not actively monitor the lifting force of the motor. Accordingly, some embodiments do not include load sensor 27. In some embodiments, a certain value is set that provides a limiting factor for the lifting force of the motor. In some embodiments, a maximum current is set. If the current requirements of the motor 28 are well known, the lifting apparatus 12 uses the relationship between the current drawn by the motor 28 and the resultant lifting force. As described above, the lifting force of a motor 28 is directly proportional to the current being drawn. Accordingly, the maximum current supplied to the motor 28 can be limited to a maximum current corresponding to the desired lifting force limit. Because the motor 28 is current limited, it will be unable to provide a force greater than that which is proportional to the maximum current.

Figure 4B:
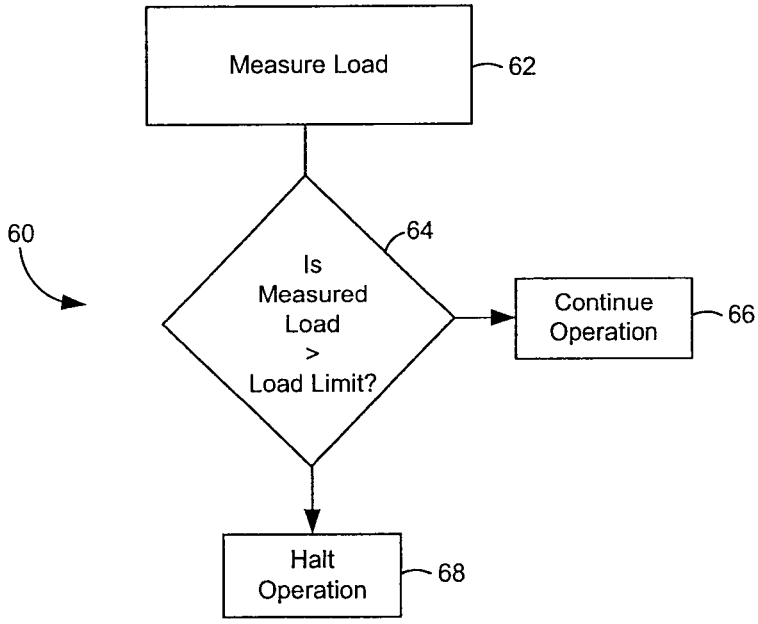
FIG. 4B is a flowchart of a method for setting the lowest load limit of a ceiling lift system in accordance with some embodiments of the present invention.

Referring now to FIG. 4B, a flowchart of a method 60 is shown that incorporates a system with specific reference to limiting the current supplied to the motor 28. In step (60), the lifting apparatus 12 reads the load limit information regarding the load-bearing components 25 from the information receiver 24. Next, a determination is made in step (64) that correlates the appropriate maximum current for the set limit of the lifting apparatus limiting the lifting force of the motor. In certain embodiments, the lowest load limit is used to ensure that the lifting apparatus 12 stays within the load limits of all the load-bearing components 25. Finally, based on this determination, a maximum current is set that limits the lifting force of the motor in step (66).

As mentioned, the method of limiting the current will accommodate for the inrush current. If the lifting force of the motor has reached its current limit, the lifting apparatus 12 may return an error condition to the user or caregiver. In some embodiments the motor 28 will stop lifting. The lifting apparatus 12 or the motor 28 may also engage a locking mechanism so that the user does not begin falling if already in a raised position.

The methods described in FIG. 4A and FIG. 4B can be implemented in both hardware and software. If implemented in software, the load limit information and maximum current are saved as software variables. Similarly, the methods 50 and 60 can be implemented using analogue or digital hardware components according to design methods known to skilled persons in the art.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A lifting apparatus for a lift system, the apparatus comprising:

a) a motor adapted for providing a lifting force;

b) at least one connector operatively connected to the motor, the connector adapted for connecting a load-bearing component to the motor;

c) an information receiver for receiving a load limit information about the load-bearing component;

d) a motor controller electrically coupled to the motor and the information receiver, wherein the motor controller is adapted to limit the lifting force of the motor based on the load limit information received by the information receiver.

2. The apparatus of claim 1, wherein the motor controller is adapted to limit the lifting force of the motor to a load limit contained in the load limit information.

3. The apparatus of claim 1, wherein the at least one connector comprises a plurality of connectors, each of the connectors adapted for connecting one of a plurality of load-bearing components.

4. The apparatus of claim 3, wherein the motor controller is adapted to compare the load limit of each load-bearing component and determine a lowest load limit, wherein the motor controller is adapted to limit the lifting force of the motor to the lowest load limit.

5. The apparatus of claim 1, further comprising a display for displaying a limit of the lifting force of the motor.

6. The apparatus of claim 3, wherein the information receiver is adapted to receive a communication from a transmitter, wherein the transmitter is associated with the load-bearing component and wherein the communication comprises the load information.

7. The apparatus of claim 6, wherein the receiver and the transmitter are electrically coupled.

8. The apparatus of claim 6, wherein the receiver and the transmitter are optically coupled.

9. The apparatus of claim 1, wherein the information receiver comprises a radio frequency receiver.

10. The apparatus of claim 6, wherein the transmitter resides on the associated load-bearing component.

11. The apparatus of claim 10, wherein at least one of the load-bearing components is selected from the group consisting of: a track, a spreader bar, and a sling.

12. The apparatus of claim 10, wherein the load information transmitted by the transmitter comprises a safe working load of the associated load-bearing component.

13. The apparatus of claim 1, further comprising at least one key, wherein the information receiver is operatively coupled to a key interface, the key interface is adapted for receiving each of the at least one key.

14. The apparatus of claim 13, wherein each of the at least one key is associated with a predetermined lifting force.

15. The apparatus of claim 14, wherein the key interface comprises a plurality of pin combinations, each pin combination is associated with a predetermined lifting force; and wherein a selected key engages a corresponding pin combination to limit the lifting force of the motor to the predetermined lifting force associated with the selected key and the pin combination.

16. The apparatus of claim 15, wherein the key comprises the display for displaying the limit of the lifting force of the motor.

17. The apparatus of claim 13, wherein the key interface resides on the apparatus.

18. The apparatus of claim 13, wherein the key interface resides on a load-bearing component, and wherein the load-bearing component is adapted to be coupled to the apparatus.

* * * * *